US006606935B2

(12) United States Patent
Jones

(10) Patent No.: US 6,606,935 B2
(45) Date of Patent: Aug. 19, 2003

(54) VARIABLE RATE PUMP

(75) Inventor: Kent R. Jones, Huntsville, AL (US)

(73) Assignee: CDS John Blue Company, Huntsville, AL (US)

( * ) Notice: Subject to any disclaimer, the term of this patent is extended or adjusted under 35 U.S.C. 154(b) by 0 days.

(21) Appl. No.: 09/988,021

(22) Filed: Nov. 16, 2001

(65) Prior Publication Data

US 2002/0056365 A1 May 16, 2002

Related U.S. Application Data

(60) Provisional application No. 60/248,843, filed on Nov. 16, 2000.

(51) Int. Cl.[7] ..... F01B 31/14; F15B 15/24

(52) U.S. Cl. ..... 92/13.7; 74/836

(58) Field of Search ..... 74/832, 834, 836; 92/13.1, 13.7

(56) References Cited

U.S. PATENT DOCUMENTS 2,592,237 A * 4/1952 Bradley ..... 92/13.7
2,892,360 A * 6/1959 Ill ..... 92/13.7
4,022,082 A * 5/1977 Uchimoto ..... 74/836
5,588,339 A * 12/1996 Dulger ..... 74/836

* cited by examiner

*Primary Examiner*—F. Daniel Lopez
(74) *Attorney, Agent, or Firm*—Pillsbury Winthrop LLP

(57) ABSTRACT

A rotational power input is converted into a linearly oscillating power output through the use of counter-rotating nested eccentrics. The outer eccentric is connected to an input end of a connecting rod, which is in turn connected at an output end thereof to a piston of a piston pump. The piston is constrained to translational movement along an axis D. Drive gears are rotationally fixed to each of the eccentrics and geared to each other through an intermediate pinion having a rotational axis B. An angular position β of the pinion axis B relative to the axis D determines the output oscillation stroke length and flow rate of the pump. An actuator is geared to a pinion bracket that holds the pinion. The actuator can be actuated on-the-fly to alter the angle β and pumping rate of the pump.

12 Claims, 6 Drawing Sheets

210
211
213
100
A
B

VARIABLE RATE PUMP

CROSS-REFERENCE

This application claims the benefit of priority to U.S. Provisional Patent Application No. 60/248,843, titled "VARIABLE RATE PUMP," filed on Nov. 16, 2000, which is incorporated herein by reference.

BACKGROUND OF THE INVENTION

1. Field of the Invention

The present invention relates generally to crankcases that convert an input rotary motion into an output linear motion, such as is required for piston pumps, and more specifically to mechanisms that vary the stroke length of such piston pumps.

2. Description of Related Art

A variety of machines require a linear, oscillating input motion for operation. For example, positive displacement piston pumps require an linear, oscillating motion to drive their pistons in and out of the piston chamber to displace a control volume within the chamber. Such piston pumps are used in farm machinery such as liquid-fertilizer distribution systems to disperse a controlled volume of liquid fertilizer.

While such machines require a linear, oscillating power source for operation, mechanical power sources are typically rotational. For example, motors and engines are typically rotational power sources. In farm machinery, for example, various implements must be powered by a rotational power take-off.

The rotational power source in farm machinery may also be a passive ground drive system that includes a ground-engaging driving wheel that rotates as the machinery is pulled over the ground. This rotation is transferred to a driveshaft through gears, belt drives, or other suitable means.

A mechanism is therefore required for converting the rotary motion input from a source, such as a chain or belt driven sprocket, to a linear motion output for use in such machines as positive displacement piston pumps. One conventional conversion mechanism utilizes a connector rod with a first end pivotally mounted to a piston of a piston pump or other linear-motion requiring machine. As a result, the first end of the connector is restricted to motion along a line that is parallel to the cylinder's axis. A second end of the connector rod is connected to a driveshaft at a pivot point that is offset from the rotational axis of the driveshaft. In practice, this is often accomplished by mounting an offset hole of an eccentric to the driveshaft. The second end of the connector rod is then mounted onto the outer cylindrical surface of the eccentric. When this eccentric system is used, the first end of the connector rod moves in a circular path around the driveshaft axis and forces the second end of the connector rod to drive the piston pump.

It is desirable to be able to selectively vary the flow rate through such machinery as piston pumps. In the case of a piston pump, the flow rate can be altered by either changing the stroke frequency or stroke length. In many situations, the speed of the input rotational power supply cannot be readily adjusted in order to adjust the resulting piston stroke frequency. For example, in the case of a ground-drive-powered piston pump, the speed of the driveshaft is controlled solely by the machinery's speed over land. In order for an operator to have selective control over the output flow rate of the piston pump, the operator must therefore be able to adjust the stroke length of the piston.

One conventional method of varying the output stroke length is to use nested locking eccentrics instead of a single eccentric as discussed above. In this case, a first eccentric having an offset hole is rotationally fixed to the driveshaft. A second eccentric has an offset hole that fits over the outer surface of the first eccentric. The eccentrics are variably rotationally fixed to each other such that a user can select their relative positions in order to alter the effective offset between the second end of the connector rod and the driveshaft axis. As a result, the stroke length of the first end of the connector is variable. Unfortunately, however, when using this conventional system, the machine must be stopped in order to allow an operator to unlock, alter, and relock the eccentrics' relative positions.

SUMMARY OF THE INVENTION

The variable rate pump according to the present invention is unique in its ability to vary its pumped output at constant input rpm by varying its stroke length or linear motion output from the crankcase on-the-fly.

BRIEF DESCRIPTION OF THE DRAWINGS

The accompanying drawings, which are incorporated in and constitute a part of the specification, illustrate a preferred embodiment of the invention and, together with the general description given above and the detailed description of the embodiment given below, serve to explain the principles of the present invention. In the figures.

DETAILED DESCRIPTION OF A PREFERRED EMBODIMENT OF THE INVENTION

A detailed description of the elements required for an understanding of the present invention is provided.

Hereinafter the rotational operation of a piston pump driving mechanism 210 according to the present invention will be described.

Figures 1A, 1B:
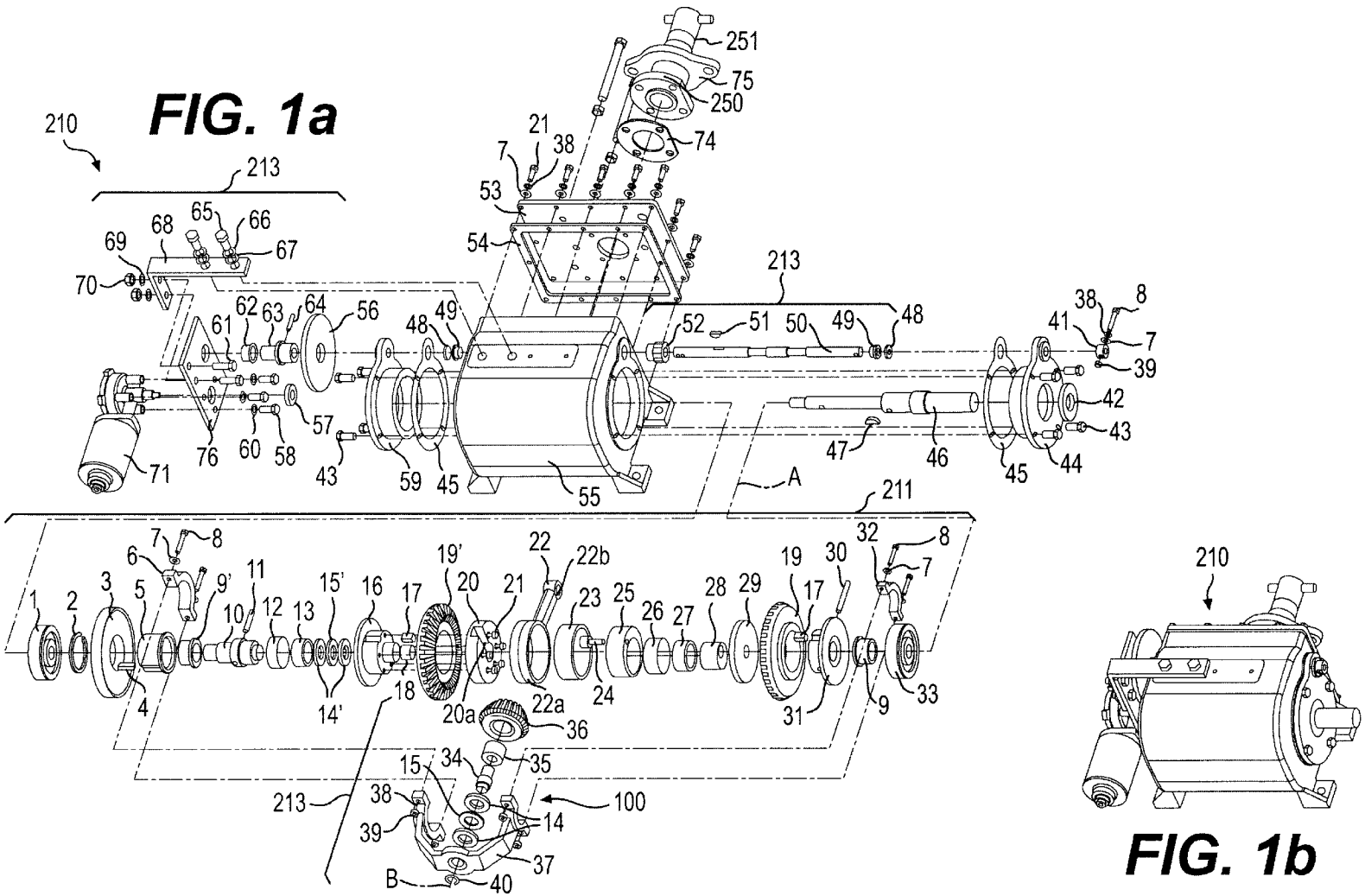
FIG. 1*a* is an exploded view of the pump of the present invention.
FIG. 1*b* is a view of the assembled pump.

As shown in the exploded view of FIG. 1, the pump 210 includes a connecting rod driving mechanism 211. The connecting rod driving mechanism has a crankcase housing 55 that supports an inboard bearing housing 44 and outboard bearing housing 59. These housings 44, 59 are held in place with bolts 43, or other suitable holding devices. During operation, the crankcase housing 55 contains oil for lubrication and therefore the bearing housings 44, 59 and crankcase housing 55 are sealed together with gaskets 45. A cover plate 53 is also affixed to the crankcase housing 55 through the use of bolts 21, lock washers 38, and flat washers 7 or other suitable devices and sealed with a cover plate gasket 54.

The inboard bearing housing 44 supports an inboard bearing 33. The outboard bearing housing 59 supports an outboard bearing 1. These bearings 1, 33 together hold and support a main driveshaft 46 such that the main driveshaft 46 is rotatable relative to the housing 55 about a long main rotational axis A. The bearings 1, 33, running in an oil bath, allow for rotation of the main driveshaft 46. The main driveshaft 46 extends through the inboard bearing housing 44 to allow for transmittal of power from an external drive source by means of a belt, chain, motor, etc. An oil seal 42 is positioned within the inboard bearing housing 44 to seal between the rotating main driveshaft 46 and the inboard bearing housing 44.

The main driveshaft 46 is slotted to accept a key 47, or other suitable device such as a spline that can restrain relative rotational movement between parts. An inner eccentric 28 includes an offset hole 28*a*, an outer cylindrical surface 28*b*, and slot 28*c*. The inner eccentric 28 is positioned on the main driveshaft 46 so as to be driven and held in fixed rotational orientation with respect to the main driveshaft 46. A centerline of the outer cylindrical surface 28*b* is offset from the axis A. An inboard gear holder 31 is positioned on the main driveshaft 46 as well and affixed with a dowel pin 30 or other suitable device to the main driveshaft 46. A drive gear 19 is affixed to the inboard gear holder 31 and is held in fixed rotational orientation thereto with a key 17 or other suitable device. Together the main driveshaft 46, inner eccentric 28, and drive gear 19 are fixed together with respect to rotational orientation about the axis A.

The main driveshaft 46 also supports a thrust holder 10 which is affixed to the driveshaft 46 with a dowel pin 11 or other suitable device. A flange bearing 9' is positioned on the thrust holder 10 to support the adjustment gear holder 5. The main driveshaft 46 also has a flange bearing 9 positioned between the inboard gear holder 31 and a shoulder on the main driveshaft 46. A pinion bracket assembly 100 comprises a pinion arm bracket 37, an inboard pinion holder 32, and an outboard pinion holder 6, which are affixed together through the use of a bolt 8, lock washer 7, flat washer 38, and nut 39 or other suitable devices. The pinion bracket assembly 100 is positioned in a manner so as to allow the main driveshaft 46 to be positioned within the long main axis A of the pinion bracket 37. The pinion bracket assembly 100 is supported by the adjustment gear holder 5 and the flange bearing 9. A second axis B within the pinion bracket assembly 100 is perpendicular to the main axis.

The drive gear 19 drives a pinion gear 36 which is at a 90 degree angle to the drive gear 19. The pinion gear 36 has along its rotational axis B, a needle bearing 35 or other suitable device, which is centered on a pinion holder 34 along the second axis B. The pinion holder 34 is positioned within the pinion bracket 37 and held in place with a retaining ring 40 or other suitable device. Due to the nature of the 90 degree positioning mentioned above, a thrust bearing composed of a raceways 14 and roller cage 15 is positioned between the pinion gear 36 and pinion arm bracket 37. The pinion gear 36 in turn drives a second drive gear 19'. The drive train ratio from drive gear 19 through the pinion gear 36 and to the second drive gear 19' is an overall 1 to 1 gear ratio. The result of the drive gears 19, 19' being positioned at 90 degrees to the pinion gear is a net rotational operation of both drive gears operating at equal rotational speeds but in opposite directions.

The secondary drive gear 19' is supported by the outboard gear holder 16 and rotationally fixed to the outboard gear holder 16 with a key 17 for common rotation about the axis A. The outboard gear holder 16 is positioned around a needle cup bearing 12 and inner race 13 which is supported in turn by the thrust holder 10. A second sleeve bearing 18 is positioned between the outboard gear holder 16 and the main driveshaft 46. The bearing 18 allows for free rotational operation of the outboard gear holder 16 with respect to the main driveshaft 46. A thrust bearing composed of raceways 14' and a roller cage 15' is positioned between the outboard gear holder 16 and thrust holder 10 due to the 90 degree positioning of the drive and pinion gears 19, 19', 36 producing a thrust force acting to separate the drive gears 19, 19'. The outboard gear holder 16 contains a bolt pattern to affix a stroke locator 20 through the use of bolts 21 or other suitable device(s). This bolt pattern is offset so as to fix a radially-extending cam slot 20*a* of the stroke locator 20 with respect to rotational orientation to the secondary drive gear 19'.

A bearing composed of an inner race 27 and needle cup 26 is positioned around the inner eccentric 28. An outer eccentric 25 has an offset inner cylindrical hole 25*a* and a cylindrical outer surface 25*b*. The inner hole 25*a* is positioned on the bearing. A centerline of the inner cylindrical hole 25*a* is offset from a centerline of the cylindrical outer surface 25*b*. This offset is equal to the offset between the axis A and the centerline of the outer cylindrical surface 28*b* of the inner eccentric 28.

A cam follower 24 is affixed to the outer eccentric 25. The cam follower 24 rides within the slot 20*a* of the stroke locator 20 and determines the outer eccentric 25 rotational position in relation to the stroke locator 20.

The description outlined above defines the following path of power transmission. Rotational input is received by the main driveshaft 46 and drives the inner eccentric 28. The main driveshaft also drives the inboard gear holder 31, which drives the drive gear 19. The drive gear 19 drives the pinion gear 36, which drives the secondary drive gear 19'. The secondary drive gear 19' drives the outboard gear holder 16, which drives the stroke locator 20. The slot 20*a* of the stroke locator 20 drives the cam follower 24, which drives the outer eccentric 25. The net result is that the inner eccentric 28 and outer eccentric 25 rotate at equal speeds in opposite directions when the axis B of the pinion bracket 37 is held at any fixed rotational position about the main long axis A.

Hereinafter, the driving mechanism for converting rotational motion into linear motion will be described.

The outer eccentric 25 supports a journal bearing 23. The journal bearing axis is coaxial to the centerline of the outer cylindrical surface 25*b* of the outer eccentric 25. The centerline of the outer cylindrical surface 25*b* defines a point 200. As discussed above, the respective offset distances of the two eccentrics 25, 28 are equal. The offsets produce a net offset between the journal bearing 23 and the main driveshaft 46. With the inner and outer eccentrics 28, 25 rotating at equivalent speeds in opposite directions, the net result of their combined offsets produces a linear oscillating motion of the journal bearing 23 and point 200 along a line C which is translated in a direction perpendicular to the main axis A.

The amount of linear translation of the point 200 along line C is equal to twice the offset of the sum of the inner and outer eccentric offsets. Thus, the total amplitude of the point 200 along line C is four times the offset of the individual eccentrics 25, 28.

Figure 5:
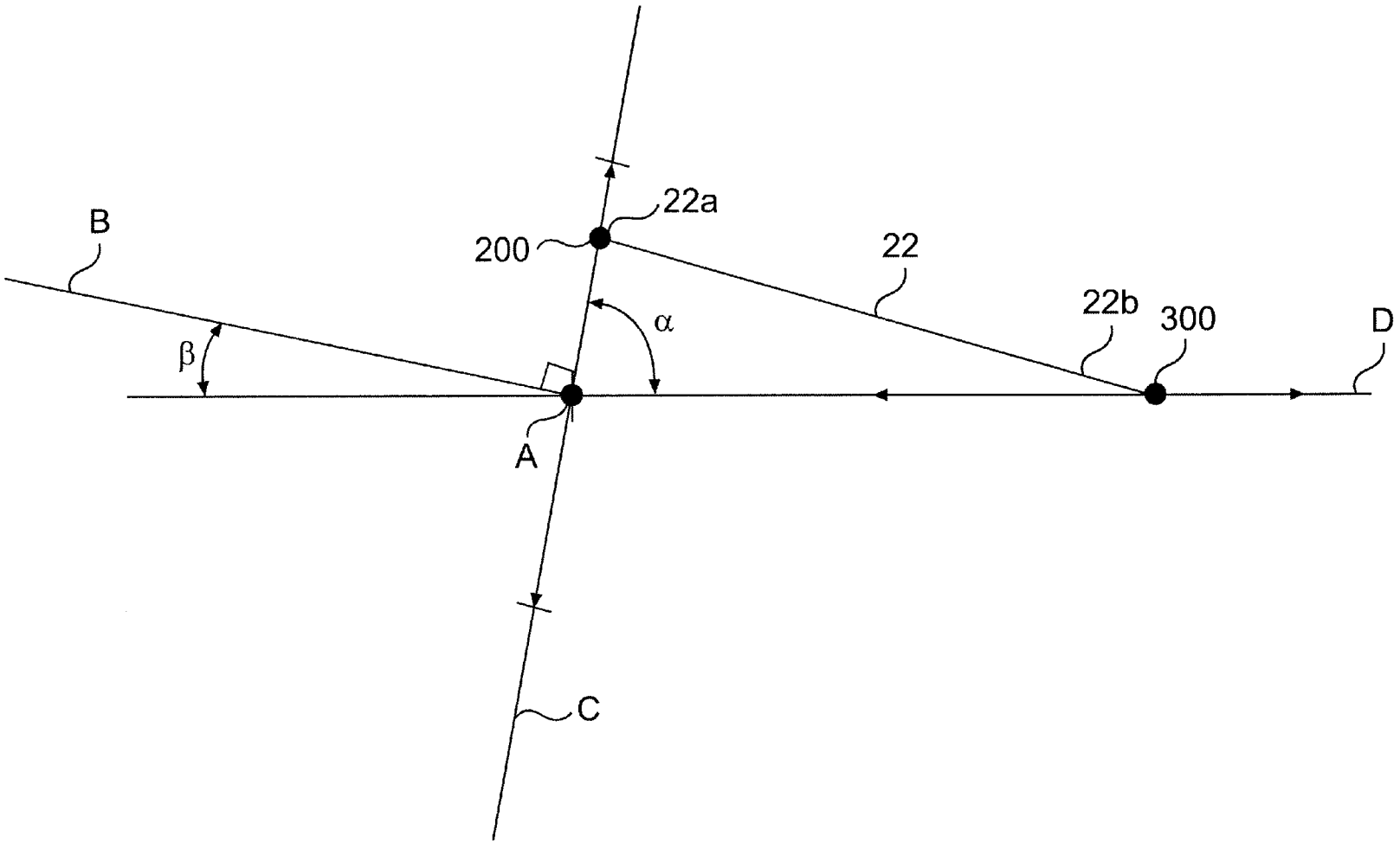
FIG. 5 is a schematic diagram representing the directional and angular movements of the pump of the present invention.

As illustrated in FIG. 5, the line C forms a variable angle (or set angle) $\alpha$ with a horizontal axis D.

In the illustrated embodiment, the line C is perpendicular to the pinion bracket's secondary axis B. However, the angular relationship between line C and axis B may be different, depending on the relative angular position of the gears 19, 19' (and consequently the eccentrics 25, 28) when they are initially meshed with the pinion 36. Nonetheless, the angle between line C and axis B is preferably set to 90 degrees, as illustrated in FIGS. 2–4, in order to provide the greatest clearance between the outer eccentric 25 and the pinion 36.

Figure 2A:
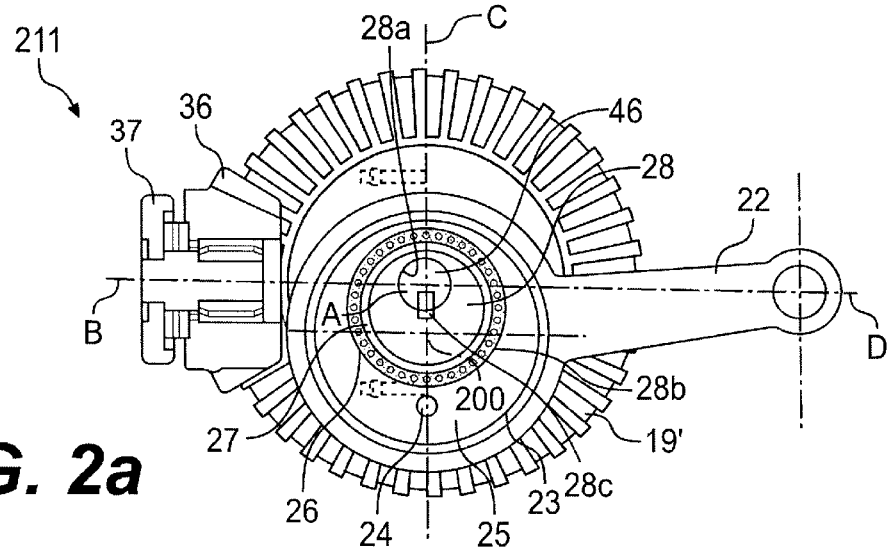
FIGS. 2*a*–2*c*, 3*a*–3*c* and 4*a*–4*c* are a partial sectional views of the pump of the present invention.
Figure 2B:
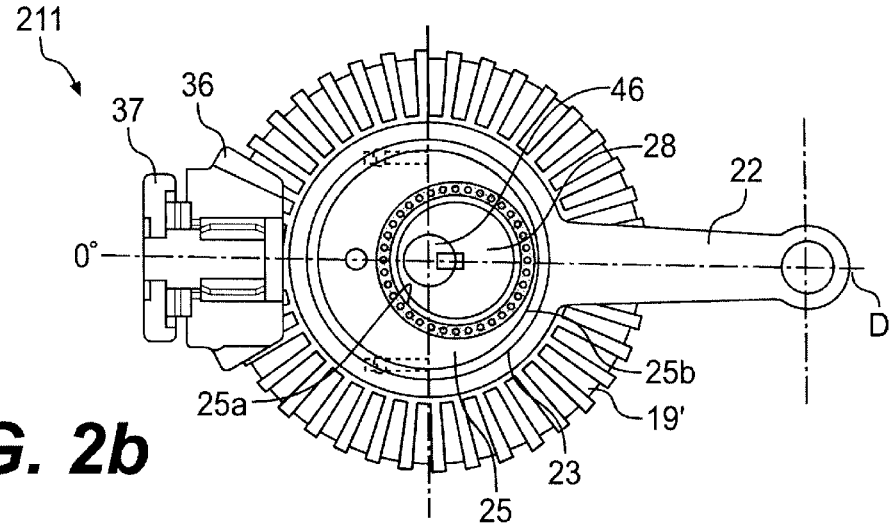
Figure 2C:
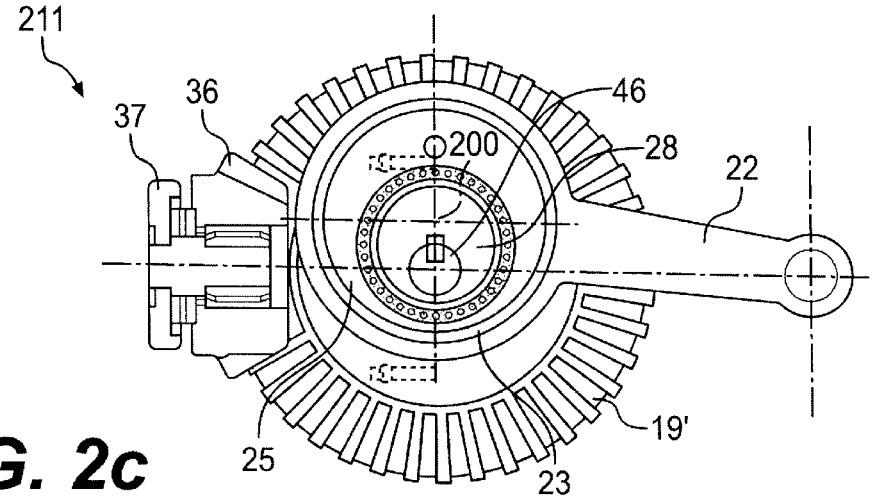
Figure 3A:
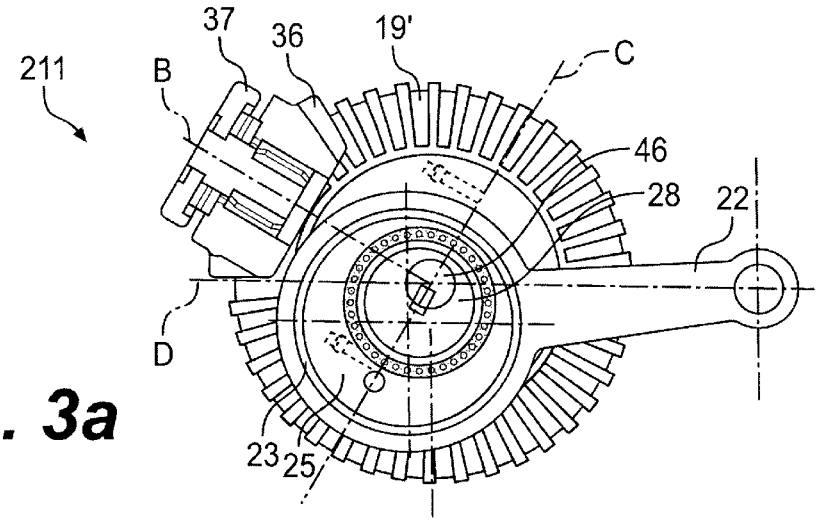
Figure 3B:
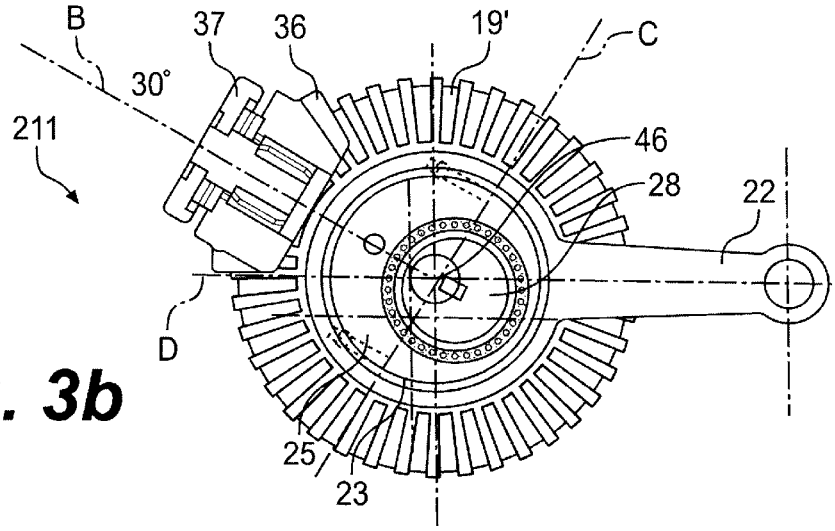
Figure 3C:
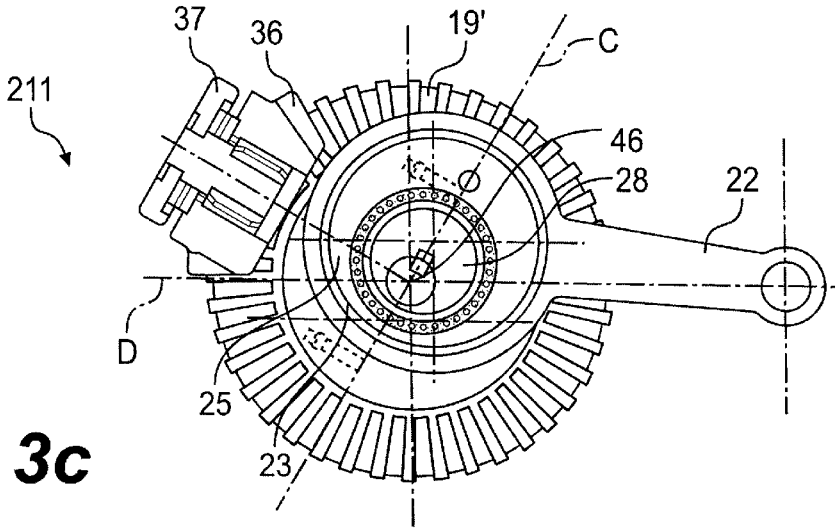
Figure 4A:
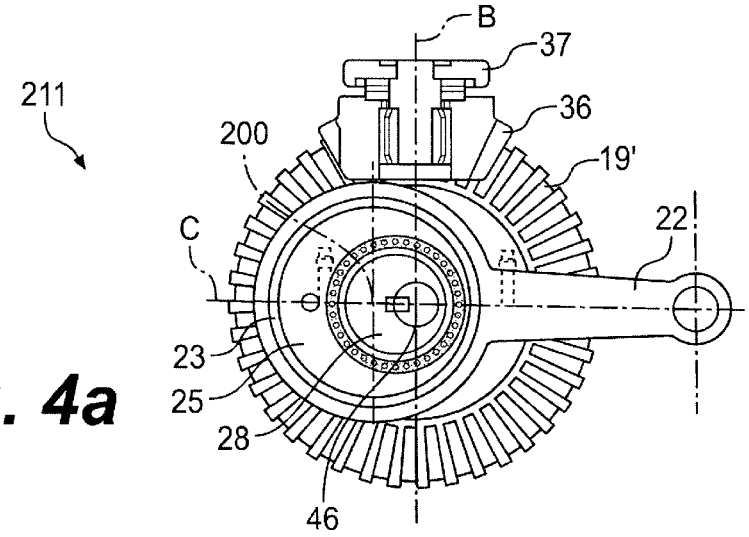
Figure 4B:
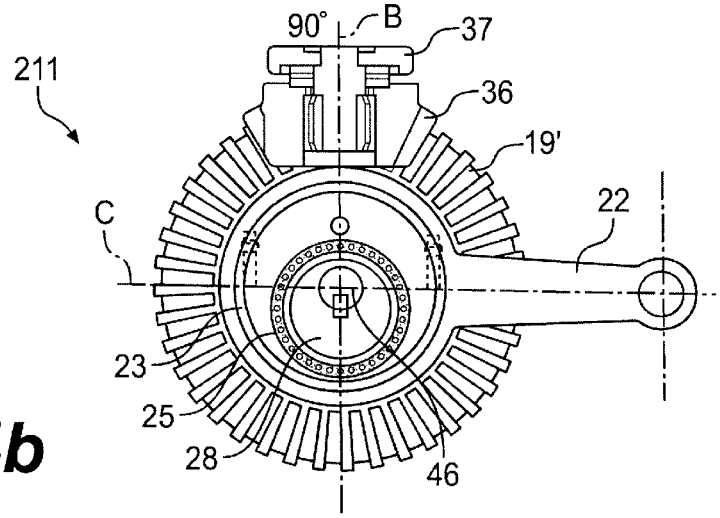
Figure 4C:
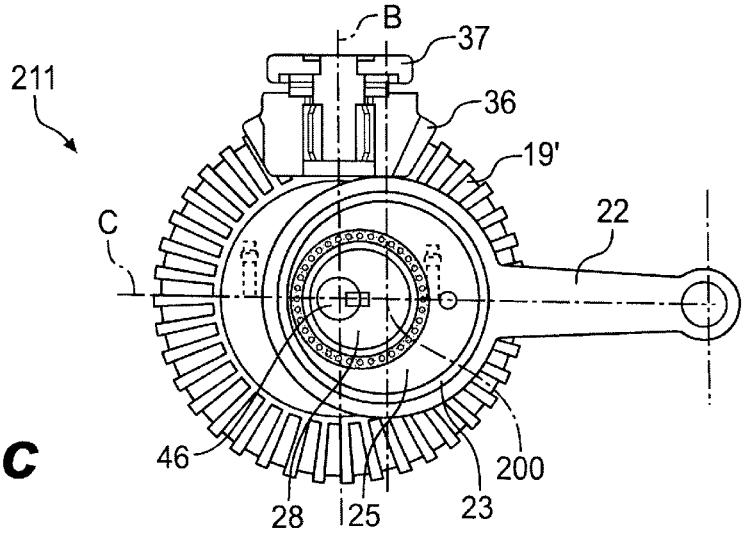

As is best illustrated in FIG. 5, because the axis B and line C form a fixed angle, an angular position β of the secondary axis B of the pinion bracket 37 relative to the horizontal axis D determines the angular position α of line C along which the journal bearing 23 and point 200 move within the crankcase housing 55. When the pinion bracket 37 is positioned as shown in FIGS. 2*a–c,* the angle β is 0 degrees and the movement of the journal bearing 23 (and point 200) is entirely up and down. When the pinion bracket 37 is positioned as shown in FIGS. 4*a–c,* the angle β is 90 degrees and the journal bearing 23 moves back and forth entirely along the axis D. When the pinion bracket 37 is positioned such that the angle β is acute as shown in FIGS. 3*a–c,* the journal bearing 23 and point 200 move along a line C that includes both vertical and horizontal components.

Hereinafter, the method of converting the linear oscillating motion of the point 200 and journal bearing 23 into linear oscillating motion of a piston 250 of a piston pump 251 along the axis D will be described.

The journal bearing 23 supports a connecting rod 22. The connecting rod 22 has a large diameter end (or input end) 22*a* which is disposed around the journal bearing 23 and a small diameter end (or output end) 22*b*. The small diameter end 22*b* is positioned within the connecting rod guide 75. The connecting rod guide 75 is affixed to the cover plate 53 and sealed with a gasket 74. The affixed position of the connecting rod guide 75 dictates that the connecting rod small end 22*b* can only move linearly along the connecting rod guide's axis D. A point 300 is defined by the centerline of the small diameter end 22*b* and is therefore disposed a fixed distance from the point 200. Consequently, as best seen in FIG. 5, the point 300 is constrained to translational movement only along axis D.

In the illustrated embodiment, the small end 22*b* is pivotally connected to a piston 250 of a piston pump 251. The piston 250 is constrained to movement along axis D such that when the small end 22*b* is connected to the piston 250, the small end 22*b* and point 300 will be constrained to translational movement along axis D.

Hereinafter, the variability of a stroke length of the small end 22*b* and point 300 will be described.

In the case illustrated in FIGS. 2*a–c* where angle β is 0 degrees, the large end 22*a* of the connecting rod 22 moves up and down along line C, which is perpendicular to the connecting rod guide axis D. Consequently, the angle α formed between the line C and the axis D is 90 degrees. In this case, the small end 22*b* of the connecting rod 22 within the connecting rod guide 75 moves a minimal linear distance along the connecting rod guide's axis D. In practice this translates to an approximate pumping rate of about 6% of capacity of the pump 251.

In the case illustrated in FIGS. 4*a–c,* the large end 22*a* of the connecting rod 22 moves linearly along the line C in a direction parallel to the axis D (angle β is 90 degrees and angle α is 0 degrees). As a result, the small end 22*b* of the connecting rod 22 moves along the connecting rod guide axis D a distance equal to the linear motion of the large end 22*a* such that the amplitude of the small end 22*b* and point 300 is four times the offset of either eccentric 25, 28.

When the angles β, α are acute as shown in FIGS. 3*a–c,* the amplitude of the linear motion of the small end 22*b* along axis D will be a fraction of the amplitude of linear motion of the large end 22*a* along the line C. This relationship results in a distinct amount of linear motion of the small end 22*b* of the connecting rod 22 for any given angle β. Therefore, the pinion bracket 37 angular position P directly dictates the resultant amount of linear travel (or amplitude) of the small end 22*b* of the connecting rod 22 within the connecting rod guide and axis 75, D.

Hereinafter, the stroke length adjusting mechanism 213 for selectively controlling the angle β (and therefore the stroke length of the piston 250) will be described with specific reference to FIGS. 1 and 5.

As described above, the linear motion of the piston 250, i.e., the stroke length or amplitude along axis D, is determined by the angular position β of the pinion bracket 37. The pinion bracket 37, as previously described, is supported by the adjustment gear holder 5. This adjustment gear holder 5 also supports the internal driven gear 3 which is keyed to the adjustment gear holder 5 with a key 4 and held in place on the adjustment gear holder 5 with a retaining ring 2 or other suitable device. The pinion bracket 37 also is slotted to receive this key 4 such that the rotational position of the internal driven gear 3 dictates the pinion bracket 37 angular position β. The internal driven (or control) gear 3 is driven by the internal drive gear 52 which is supported by the adjustment shaft 50. The internal drive gear 52 and adjustment shaft 50 are keyed together by the key 51. The adjustment shaft 50 is supported by two flange bearings 49 which are positioned within the crankcase housing 55. Two o-rings 48 serve as seals between the crankcase housing 55 and adjustment shaft 50.

The adjustment shaft 50 extends through the crankcase housing 55 at both ends. One end of the adjustment shaft 50 has affixed thereon a collar 41 with a bolt 8, lock washer 38, flat washer 7, and nut 39 or other suitable device. This collar 41 serves to prevent axial movement of the adjustment shaft 50 and therefore aligns the internal drive and driven gears 3, 52. The other end of the adjustment shaft 50 supports a gear bore 63 which is affixed to the adjustment shaft 50 with a dowel pin 64 or other suitable device. An external driven gear 56 is welded (or otherwise rotationally fixed) to the gear bore 63. The gear bore 63 also supports a flange bearing 62 which is positioned within the actuator bracket mount 76. This actuator bracket mount 76 also supports an actuator 71 which is affixed to the actuator bracket mount 76 with a bolt 58 and lock washer 60. Positioned on the actuator shaft is an external drive (or control) gear 57 which is positioned to drive the external driven gear 56. The actuator mount bracket 76 is held in place by the actuator arm bracket 68 which is affixed to the actuator mount bracket 76 with bolts 61, lock washers 69, and nuts 70 or other suitable device(s). The actuator arm bracket 68 is affixed to the crankcase housing 55 with bolts 65, lock washers 66, and flat washers 67 or other suitable device(s).

The pinion bracket 37 angular position β dictates the stroke length of the pump 251 and therefore its pumped output per revolution of the main driveshaft 46. During operation at any given stroke, the pinion bracket 37 position β may be held stationary. Altering the angular position β of the pinion bracket 37, and therefore the stroke length, is accomplished by actuating the motor (or actuator) 71, which rotates the external drive gear 57, which drives the external driven gear 56, which drives the gear bore 63, which drives the adjustment shaft 50, which drives the internal drive gear 52, which drives the internal driven gear 3, which is keyed to the adjustment gear holder 5 and the pinion bracket 37. Once the desired new angular position β is achieved, the actuation is stopped and the pinion bracket 37 held in place. The high degree of gear reduction between the actuator 71 and the pinion bracket 37 allows a less powerful actuator 71 to be used to rotate the pinion bracket 37 and also isolates the actuator 71 to a certain degree from the relatively high forces resulting from the pumping operation that attempt to push the pinion bracket 37 to the position of least work, i.e., to a position wherein the angle β is 0 degrees.

The actuator 71 is connected to a conventional electric control circuit that permits an operator to selectively operate the actuator 71.

While in the illustrated embodiment, the control mechanism comprises a motor 71, the present invention is not so limited. For example, a hand crank geared to the internal driven gear could also be employed such that the angle β can be manually varied by an operator.

The angular position β of the pinion bracket 37 is determined through the use of a sensor (not shown) such as a potentiometer which is positioned to read the angular position of the gear bore 63. An alternative method of determining angular position β would be to use sensors that would read the relative angular position of the inboard gear holder 31 and outboard gear holder 16. The angular positions of these gear holders dictates the phase of the drive gears 19, 19', which also is repeatable and a function of the mechanism to determine the stroke length of the pump 251. Alternatively, a combination of both of types of sensors could be used.

Figure 6:
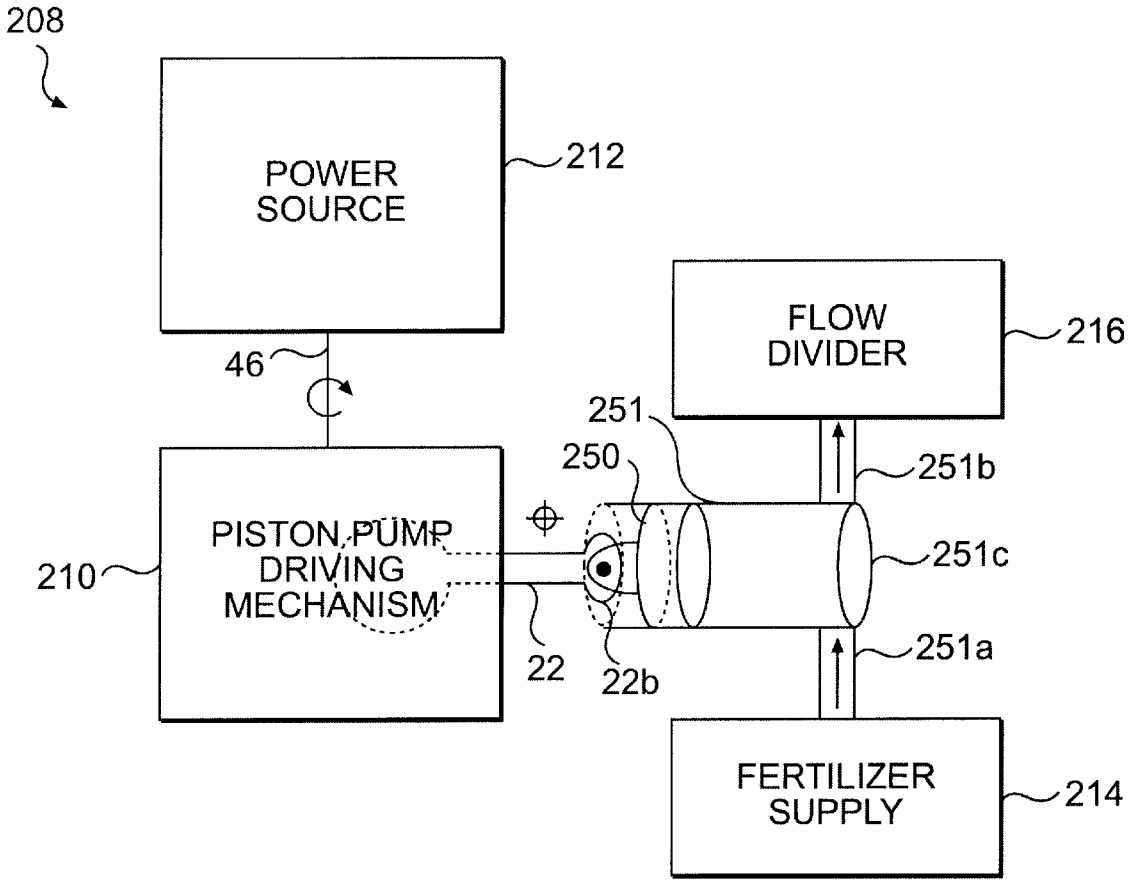
FIG. 6 is a block diagram of a liquid-fertilizer distribution system according to the present invention.

Hereinafter, an implementation of the present invention into a liquid-fertilizer distribution system 208 will be described with reference to the block diagram in FIG. 6. A power source 212 is operatively connected to the driveshaft 46 of the piston pump driving mechanism 210. In the illustrated embodiment, the power source is a ground-drive system, as would be understood by one skilled in the art. Alternatively, the power source 212 could also be an electric or hydrostatic motor, an internal combustion engine, a power-take-off, or other suitable rotational power source. The output end (or small diameter end) 22*b* of the connecting rod 22 is operatively connected to the piston 250 of the piston pump 251. While the piston pump 251 is generically illustrated in FIG. 6, the piston pump 251 is preferably a positive displacement double-acting pump that accurately meters the amount of liquid fertilizer pumped therethrough. The piston pump 251 includes a body portion 251*c* having input and output ports 251*a*, 251*b*, through which liquid fertilizer is designed to flow. The input port 251*a* is operatively connected to a fertilizer supply 214, which is preferably a large container such as a 300 gallon tank. The output port 251*b* of the piston pump 251 is operatively connected to a flow divider 216, such as the flow divider disclosed in U.S. Pat. No. 6,311,716, which is incorporated herein by reference.

The fertilizer distribution system 208 may be pulled behind or mounted onto a vehicle such as a tractor.

The fertilizer distribution system 208 offers several advantages over conventional liquid-fertilizer distribution systems. In conventional ground-driven liquid-fertilizer distribution systems utilizing a single eccentric in a piston pump driving mechanism, fertilizer is pumped through the pump and dispersed at an invariable volume/acre rate. While the conventional fixed two-eccentric pump allows an operator to manually vary the stroke length and therefore the fertilizer volume/acre distribution rate, the relative positions of the two eccentrics cannot be changed on-the-fly (i.e., during dynamic operation of the fertilizer distribution system). Rather, an operator must stop work and manually change the offset and stroke length. The fertilizer distribution system 208 of the present invention solves this problem by permitting infinitely-variable on-the-fly variations to the stroke length and associated fertilizer volume/acre distribution rate.

From the invention thus described, it will be obvious to those skilled in the art that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A piston pump driving mechanism for driving a piston of a piston pump, the mechanism being capable of altering a drive stroke length of the piston pump during dynamic operation of the piston pump and comprising:

a connecting rod having an output end constructed and arranged to be connected to the piston, and a driven input end, the piston being driven along a first axis;

a connecting rod driving mechanism that drives the input end of the connecting rod along a second axis, the second axis being at a set angle with respect to the first axis, the stroke length of the piston being determined by the set angle between the first and second axes; and a stroke length adjusting mechanism operatively connected to the connecting rod driving mechanism and arranged to change the set angle of the second axis along which the input end of the connecting rod is driven during driven movement of the input end of the connecting rod.

2. The piston pump driving mechanism of claim 1, wherein the connecting rod driving mechanism comprises:

a housing;

a driveshaft mounted to the housing for relative rotation therebetween about a third rotational axis, the driveshaft being constructed and arranged to be drivingly connected to a rotational power source;

an inner eccentric having an outer cylindrical surface, the inner eccentric being rotationally fixed to the driveshaft such that a centerline of the outer cylindrical surface of the inner eccentric is offset from the third rotational axis;

an outer eccentric having an outer cylindrical surface and an offset inner cylindrical hole, the inner hole of the outer eccentric being mounted over the outer cylindrical surface of the inner eccentric to permit relative rotation therebetween, the inner hole of the outer eccentric being concentric with the outer cylindrical surface of the inner eccentric, the input end of the connecting rod being connected to the outer cylindrical surface of the outer eccentric to permit relative rotation therebetween; and a gearing mechanism that rotates the outer eccentric at a same speed as the inner eccentric, but in an opposite direction.

3. The piston pump driving mechanism of claim 2, wherein an offset between the third axis and the centerline of the outer cylindrical surface of the inner eccentric is equal to an offset between the centerlines of the outer cylindrical surface of the outer eccentric and the inner cylindrical hole of the outer eccentric.

4. The piston pump driving mechanism of claim 2, wherein the gearing mechanism comprises:

a drive gear rotationally fixed to the driveshaft;

a pinion having a fourth rotational axis, the pinion meshing with and being rotationally driven by the drive gear, the fourth rotational axis forming a predetermined angle with the second axis about the third axis;

a secondary drive gear mounted on the driveshaft to allow relative rotation therebetween about the third rotational axis, the secondary drive gear meshing with and being rotationally driven by the pinion;

a stroke locator rotationally fixed to the secondary drive gear, the stroke locator having a radially-extending cam slot; and a cam follower fixed to the outer eccentric, a cam portion of the cam follower being fit into the cam slot such that the outer eccentric rotates in common with the stroke locator, while allowing relative radial movement therebetween.

5. The piston pump driving mechanism of claim 4, wherein the predetermined angle between the second and fourth axes is about 90 degrees.

6. The piston pump driving mechanism of claim 4, wherein the stroke length adjusting mechanism selectively rotates the fourth axis about the third axis selectively change the set angle of the second axis.

7. The piston pump driving mechanism of claim 6, wherein the stroke length adjusting mechanism comprises:

a pinion arm bracket mounted to the driveshaft for relative rotation therebetween about the third axis, the pinion being mounted to the pinion arm bracket for relative rotation therebetween about the fourth axis;

a first control gear mounted to the pinion arm bracket for common rotation about the third rotational axis;

a rotational actuator mounted to the housing and having a second control gear that drives the first control gear such that actuation of the actuator determines the set angle of the second axis.

8. The piston pump driving mechanism of claim 7, wherein the first control gear drives the second control gear through at least one intermediate gear.

9. A liquid-fertilizer distribution system comprising:

a fertilizer-pumping piston pump comprising
a body portion having input and output ports, and
a piston that is movable along a first axis;

a liquid fertilizer supply communicating with the input port of the piston pump; and a piston pump driving mechanism comprising
a connecting rod having an output end connected to the piston, and a driven input end,
a connecting rod driving mechanism that drives the input end of the connecting rod along a second axis, the second axis being at a set angle with respect to the first axis, the stroke length of the piston being determined by the set angle between the first and second axes, and a stroke length adjusting mechanism operatively connected to the connecting rod driving mechanism and arranged to change the set angle of the second axis along which the input end of the connecting rod is driven during driven movement of the input end of the connecting rod.

10. A stroke length adjusting mechanism comprising:

a connecting rod having an output end movable along a first line, and an input end movable along a second line;

a driving mechanism that oscillates the input end over a predetermined distance along the second line;

a stroke length adjusting mechanism that selectively determines a set angle formed between the first and second lines, the set angle determining a stroke length of the output end along the first line.

11. The stroke length adjusting mechanism of claim 10, wherein the driving mechanism comprises a mechanism that converts a rotational motion input into a linear oscillation output of the input end of the connecting rod along the second line.

12. A driving mechanism for converting rotational movement into linear oscillation, the driving mechanism comprising:

a housing;

a rotating driveshaft mounted to the housing for relative rotation therebetween about a first rotational axis, the driveshaft being constructed and arranged to be drivingly connected to a rotational power source;

an inner eccentric having an outer cylindrical surface, the inner eccentric being rotationally fixed to the driveshaft such that a centerline of the outer cylindrical surface of the inner eccentric is offset from the first rotational axis;

an outer eccentric having an outer cylindrical surface and an offset inner cylindrical hole, the inner hole of the outer eccentric being mounted over the outer cylindrical surface of the inner eccentric to permit relative rotation therebetween, the inner hole of the outer eccentric being concentric with the outer cylindrical surface of the inner eccentric; and a gearing mechanism that rotates the outer eccentric at a same speed as the inner eccentric, but in an opposite direction.

* * * * *